US010641232B2

(12) United States Patent
Morrow, Jr. et al.

(10) Patent No.: US 10,641,232 B2
(45) Date of Patent: May 5, 2020

(54) IGNITION COIL DWELL CONTROL

(71) Applicant: Ford Global Technologies, LLC, Dearborn, MI (US)

(72) Inventors: Nelson William Morrow, Jr., Saline, MI (US); Robert Humphrey, Saline, MI (US); Oliver Berkemeier, Bergisch Gladbach (DE)

(73) Assignee: Ford Global Technologies, LLC, Dearborn, MI (US)

( * ) Notice: Subject to any disclaimer, the term of this patent is extended or adjusted under 35 U.S.C. 154(b) by 295 days.

(21) Appl. No.: 15/715,060

(22) Filed: Sep. 25, 2017

(65) Prior Publication Data

US 2019/0093621 A1 Mar. 28, 2019

(51) Int. Cl.

*F02P 5/15* (2006.01)
*F02P 3/045* (2006.01)
*F02P 13/00* (2006.01)

(52) U.S. Cl.

CPC ..... *F02P 5/151* (2013.01); *F02P 3/0456* (2013.01); *F02P 13/00* (2013.01)

(58) Field of Classification Search

CPC ..... F02P 3/045; F02P 3/0456; F02P 3/0853; F02P 3/0869; F02P 5/151

See application file for complete search history.

(56) References Cited

U.S. PATENT DOCUMENTS 5,896,848 A * 4/1999 Dixon ..... F02P 3/0456 123/609
5,913,302 A * 6/1999 Ruman ..... F02B 77/04 123/609
2006/0000460 A1 1/2006 Masters et al.
2011/0041803 A1* 2/2011 Qu ..... F02P 15/10 123/406.2
2011/0144881 A1* 6/2011 Glugla ..... F02P 15/08 701/102
2016/0298593 A1* 10/2016 Lorenz ..... F02D 41/009
2018/0135590 A1* 5/2018 Brandl, Jr. ..... F02P 9/002

FOREIGN PATENT DOCUMENTS

EP 1835172 A2 9/2007

* cited by examiner

*Primary Examiner* — Sizo B Vilakazi
*Assistant Examiner* — Anthony L Bacon
(74) *Attorney, Agent, or Firm* — Geoffrey Brumbaugh; McCoy Russell LLP

(57) ABSTRACT

Approaches for controlling dwell time in the ignition system of an internal combustion engine are provided. In one example, a method may include adjusting dwell based on engine operating conditions and further adjusting dwell in a manner proportional to existent spark plug conditions. By constantly assessing spark plug condition during operating of the internal combustion engine, premature wear of the spark plug may be prevented leading to an extension in the service life of spark plug and other ignition system components.

19 Claims, 4 Drawing Sheets

IGNITION COIL DWELL CONTROL

FIELD

The present description relates generally to methods and systems for controlling dwell time in the ignition system of an internal combustion engine in proportion to spark plug life.

BACKGROUND/SUMMARY

Engine systems with spark ignition modules may be configured to achieve peak power outputs to meet engine operating requirements. In inductive spark ignition engines, an ignition coil may provide the necessary spark energy to effect the spark plugs to ignite a homogeneous air-fuel mixture in the combustion chamber, causing engine rotation. The ignition coil includes a primary winding and a secondary winding. One end of the primary winding is connected to a battery (e.g. 12 V DC) wherein high peak current steadily flows from the battery through the primary winding of the coil to establish an electromagnetic field in the ignition coil core, while the other end is connected to a switching mechanism. The tip of the spark plug contains a gap that the voltage must jump across for sparking to occur. In order to actuate a spark plug for ignition, the switching mechanism is disconnected, thereby rapidly collapsing the magnetic field within the primary winding and inducing a high voltage current in the secondary winding of the ignition coil, which is connected to a spark plug. The high voltage in the ignition coil produces spark energy (e.g. produces a spark) across the gap between spark plug electrodes to ignite the air-fuel mixture for combustion.

The spark energy provided by the ignition coils results from the time that current flows through the ignition coil. The time during which current flows within the ignition coil or in other words, the period of time for which the ignition coil is charged is termed dwell or dwell time. The energy of the ignition spark may directly influence engine performance wherein an ignition spark with low energy resulting from reduced dwell time may cause unreliable combustion. On the other hand, high spark energy and longer spark duration may be effective at preventing engine misfiring and may be obtained with higher dwell times. However, while high current supplied to the ignition coil may yield high spark energy with longer spark duration during high engine speed and load conditions, the high current supply may also contribute to premature wearing of the spark plug gap through electrode burn, increasing the spark plug gap size and increasing overall wear of the ignition system. Further, at low engine speed and load conditions, it may become necessary to provide longer spark duration to ensure ignition, which may again necessitate high current flow through the ignition coil for higher dwell, leading to increased wear of the ignition system.

The inventors herein have recognized potential issues with the above approach and provide a method to control an ignition system, with which the service life of spark plugs may be increased and ignition system wear may be decreased. As one example, the required dwell (e.g., required current supplied to the ignition coil) may be a function of the spark plug gap size wherein, at a given speed/load of the engine, a relatively new spark plug with smaller gap size may require less current to breakdown a relatively smaller spark plug gap as compared to the end of life spark plugs with a relatively bigger gap size. Selecting a dwell time based on engine operating conditions, if not adjusted to accommodate variation in the spark plug age and gap size seen over time, may negatively affect power output and engine performance. In light of these issues, it may be desirable to have an improved control of dwell time proportional to spark plug age and spark plug gap size such that ignition system wear may be reduced.

In one example, the issues described above may be addressed by a method for an internal combustion engine comprising adjusting spark plug dwell based on engine operating conditions, and further adjusting the spark plug dwell in proportion to existent spark plug conditions to derive an adjusted spark plug dwell time controlling a supply of current to an ignition coil. In this way, dwell time may be calibrated as warranted by engine operating conditions and may be further calibrated proportional to spark plug age and spark plug gap size, at a given time. As one example, scalar factors are applied to a baseline dwell time based on both engine load/speed and spark plug gap size to produce an increased dwell time when spark plug age/gap size is high and engine speed/load is high, or when spark plug age/gap size is low and engine speed/load is low.

The present disclosure may offer several advantages. By adjusting dwell time responsive to engine speed and load, premature wear of spark plugs may be effectively reduced and life of the spark plugs may be extended. Additionally, by further adjusting dwell time proportional to spark plug age and spark plug gap size, overall electrical energy consumption may be decreased leading to reduced heating and aging of the ignition coil, thereby reducing component stress, the rate of wear and extending the life span of ignition system components. Worn out spark plugs often incur deposits on spark electrodes known as spark plug fouling. Fouling of spark plugs may prevent a spark from breaking down the gap between spark plug electrodes for ignition to occur. By slowing down in the rate of wear of spark plugs by adjusting dwell, spark plug fouling may be prevented as well. In this way, overall wear of the ignition system and its components may be prevented.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
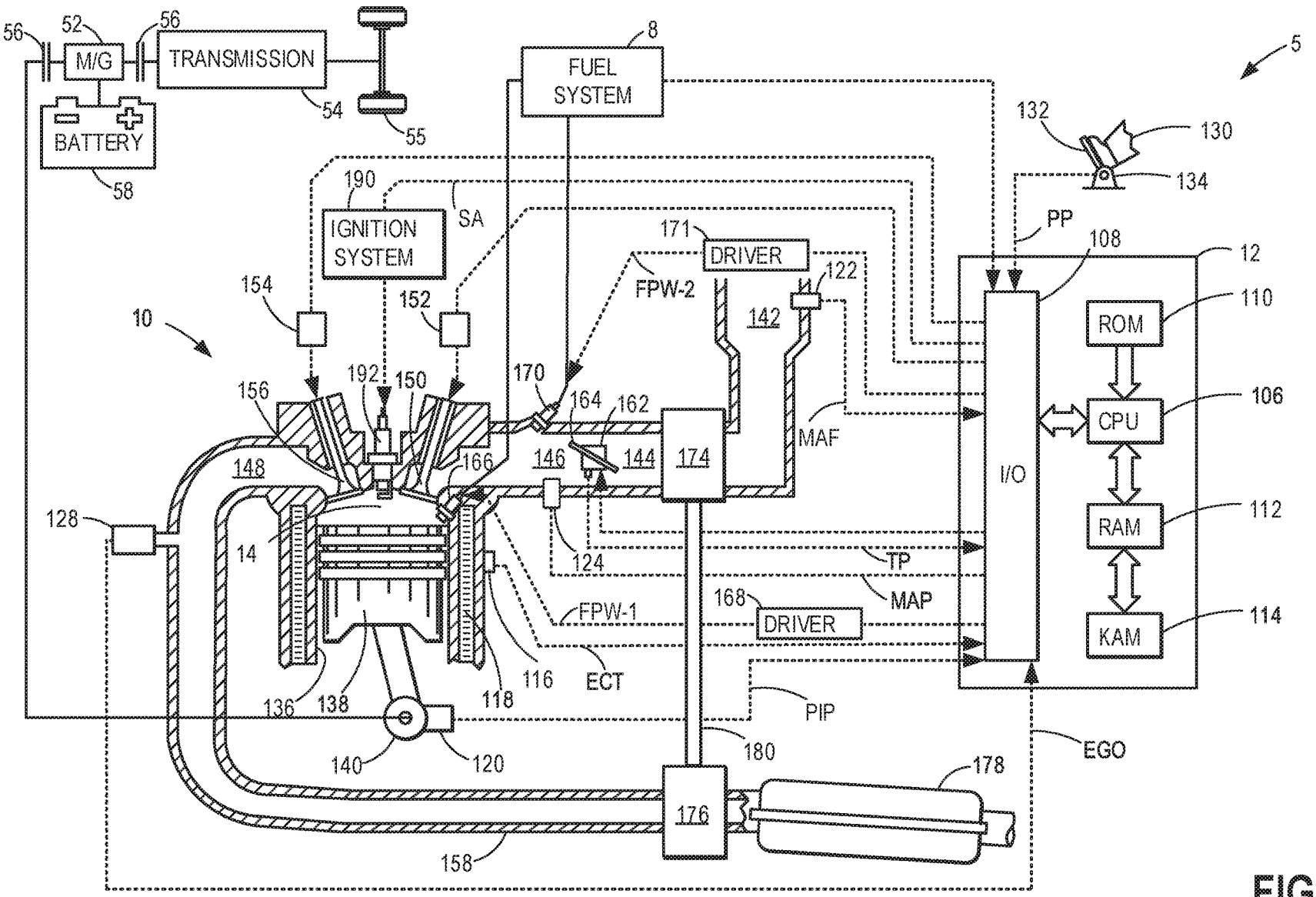
FIG. 1 is a schematic diagram of an engine.

The following description relates to systems and methods for controlling dwell time in the ignition system of an internal combustion engine, such as the example engine system of FIG. 1. Optimal engine performance may be achieved by providing high voltage spark energy for higher dwell in an ignition system such as the ignition system shown in FIG. 2 when an engine is operating at high speed and load conditions, while providing a longer spark duration by increasing dwell for an engine operating at low speed and load conditions. A baseline amount of dwell provided may be obtained from a base dwell look-up table included in a control module of the vehicle. The baseline dwell time may be additionally calibrated to be proportional to spark plug conditions (e.g. age and gap size between spark plug electrodes). Spark plug gap size may be calculated based on accumulated mileage information, the electrode material, and the geometry of the spark plug fitted in the ignition system. Based on the calculated spark plug gap size, an adjusted dwell time may be calculated. To derive the adjusted dwell time for optimal spark plug firing, a scalar quantity may be calculated (e.g., based at least on the calculated spark plug gap size), which when multiplied with a baseline or a currently operating dwell time would yield the adjusted dwell time.

Figure 3:
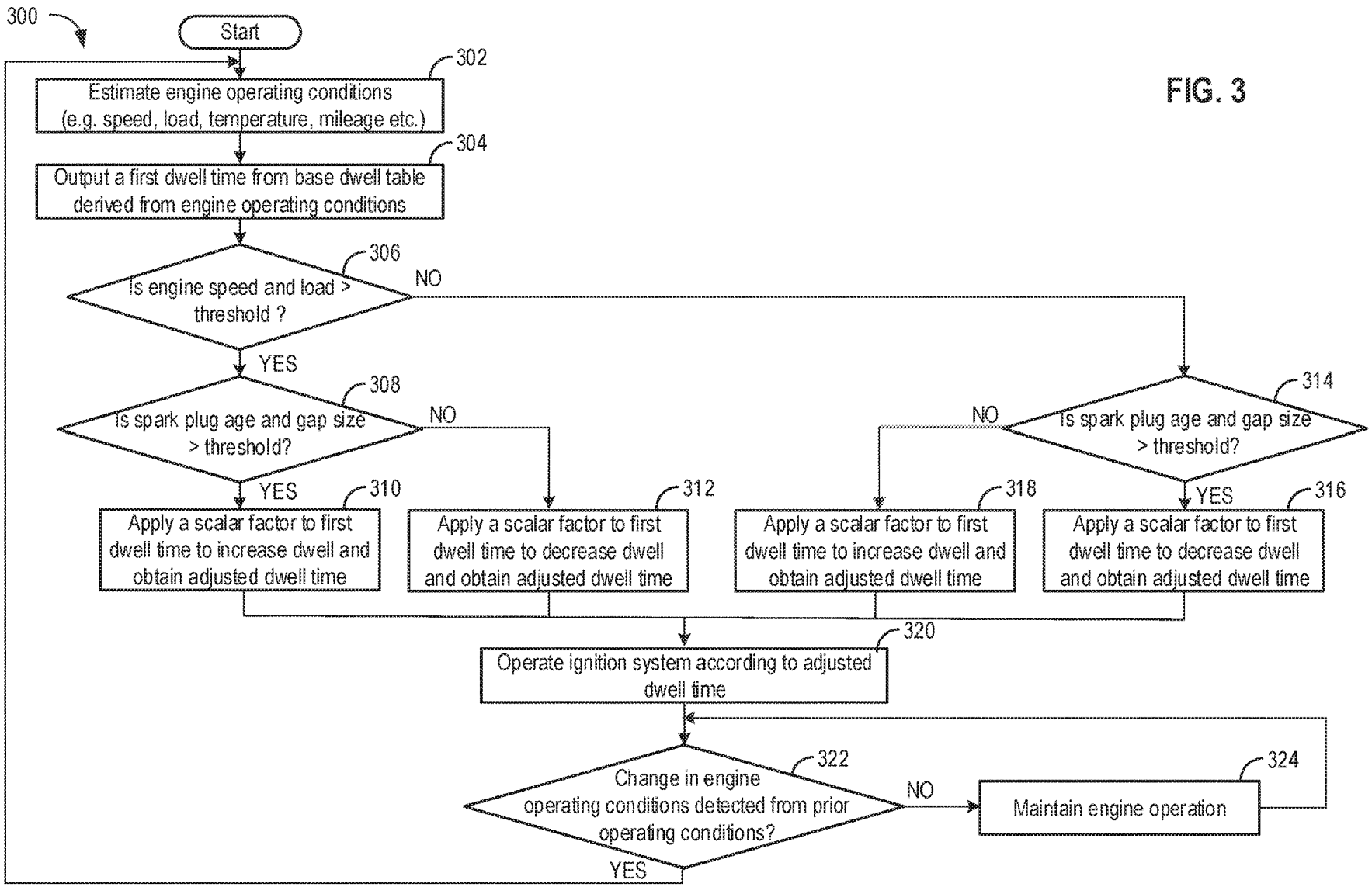
FIG. 3 shows a flowchart illustrating a method for adjusting dwell time

A controller may be configured to perform a dwell adjustment routine, such as the example routine of FIG. 3, wherein in one example, scalar factors are applied to a baseline dwell time based on both engine load/speed and spark plug gap size. Small gap sizes may produce more reliable sparks, but may be more prone to producing weak sparks when using a baseline dwell. Accordingly, small gap sizes may benefit from increased energy (e.g., increased dwell times) at low loads, when fuel may be more difficult to ignite. However, at high loads, when fuel is easily ignited, energy may be saved by reducing a voltage applied to produce the spark. In comparison, large gap sizes may produce stronger sparks, but may have a harder time producing a spark (e.g., due to the increased width over which the spark is to traverse). Accordingly, in comparison to small gap sizes, large gap sizes may benefit more from increased voltages (e.g., increased dwell times) at high loads in order to ensure that a spark is produced. However, the strong sparks created by spark plugs with large gap sizes provide for adjusting dwell time to a lesser degree than dwell times for spark plugs with small gap sizes that may require longer spark duration for hard to ignite operating conditions compared to ignitability requirements of large gap sizes. Accordingly, for an engine fitted with spark plugs that are new and have relatively small gap sizes (e.g., relative to older spark plugs with relatively large gap sizes), a first, larger scalar factor may be applied to increase dwell during engine idle conditions and/or low speed and load conditions. Then as the spark plug ages and the spark plug gap increases, a second, smaller scalar factor (e.g., smaller than the first scalar factor) may be applied to reduce dwell to match the reduction in energy demand resulting from the increased spark plug gap size. In another example, for an engine fitted with spark plugs that are new and comprise relatively small gap sizes (e.g., relative to older spark plugs with relatively large gap sizes), a third, smaller scalar factor may be applied to reduce dwell during high engine speed and load conditions, then as the spark plug ages and the spark plug gap increases, a fourth, larger scalar (larger than the third scalar factor) may be applied to obtain more dwell to match the increasing demand of spark energy. In this way, engine power output may be maximized while premature wear of the components of the ignition system may be prevented.

Turning to FIG. 1, a schematic diagram showing one cylinder of multi-cylinder internal combustion engine 10 of a vehicle system 5 is shown. Engine 10 may also be referred to herein as engine system 10. Engine 10 may be controlled at least partially by a control system including controller 12 and by input from a vehicle operator 130 via an input device 132. In this example, input device 132 includes an accelerator pedal and a pedal position sensor 134 for generating a proportional pedal position signal PP. Cylinder 14 (herein also termed combustion chamber 14) of engine 10 may include combustion chamber walls 136 with piston 138 positioned therein. Piston 138 may be coupled to crankshaft 140 so that reciprocating motion of the piston is translated into rotational motion of the crankshaft. Crankshaft 140 may be coupled to at least one drive wheel of the passenger vehicle via a transmission system (not shown). Further, a starter motor (not shown) may be coupled to crankshaft 140 via a flywheel (not shown) to enable a starting operation of engine 10.

Cylinder 14 can receive intake air via a series of intake air passages 142, 144, and 146. Intake air passages 142, 144, and 146 can communicate with other cylinders of engine 10 in addition to cylinder 14. In some examples, one or more of the intake passages may include a boosting device such as a turbocharger or a supercharger. For example, FIG. 1 shows engine 10 configured with a turbocharger including a compressor 174 arranged between intake air passages 142 and 144, and an exhaust turbine 176 arranged along exhaust passage 158.

Intake air passage 146 may comprise a common intake manifold that supplies air to all of the cylinders of engine 10. Intake air passage 146 may therefore also be referred to herein as intake manifold 146. Thus, the engine intake may comprise a single common intake passage in the portion of the intake comprising the intake air passage 146. In this way, intake manifold 146 may feed all of the cylinders of engine 10. In some examples, the engine 10 may include separate intake ducts for each cylinder of engine 10, and thus the number of intake ducts included in the engine 10 may be equivalent to the number of cylinders of engine 10.

Compressor 174 may be at least partially powered by exhaust turbine 176 via a shaft 180 where the boosting device is configured as a turbocharger. However, in other examples, such as where engine 10 is provided with a supercharger, exhaust turbine 176 may be optionally omitted, where compressor 174 may be powered by mechanical input from a motor or the engine. A throttle 162 including a throttle plate 164 may be provided along an intake passage of the engine for varying the flow rate and/or pressure of intake air provided to the engine cylinders. For example, throttle 162 may be positioned downstream of compressor 174 as shown in FIG. 1, or alternatively may be provided upstream of compressor 174.

Exhaust manifold 148 can receive exhaust gases from other cylinders of engine 10 in addition to cylinder 14. Exhaust gas sensor 128 is shown coupled to exhaust passage 158 upstream of emission control device 178. Sensor 128 may be selected from among various suitable sensors for providing an indication of exhaust gas air/fuel ratio such as a linear oxygen sensor or UEGO (universal or wide-range exhaust gas oxygen), a two-state oxygen sensor or EGO (as depicted), a HEGO (heated EGO), a NOx, HC, or CO sensor, for example. Emission control device 178 may be a three way catalyst (TWC), NOx trap, various other emission control devices, or combinations thereof.

Each cylinder of engine 10 may include one or more intake valves and one or more exhaust valves. For example, cylinder 14 is shown including at least one intake poppet valve 150 and at least one exhaust poppet valve 156 located at an upper region of cylinder 14. In some examples, each cylinder of engine 10, including cylinder 14, may include at least two intake poppet valves and at least two exhaust poppet valves located at an upper region of the cylinder.

Intake valve 150 may be controlled by controller 12 via actuator 152. Similarly, exhaust valve 156 may be controlled by controller 12 via actuator 154. During some conditions, controller 12 may vary the signals provided to actuators 152 and 154 to control the opening and closing of the respective intake and exhaust valves. The position of intake valve 150 and exhaust valve 156 may be determined by respective valve position sensors (not shown). The valve actuators may be of the electric valve actuation type or cam actuation type, or a combination thereof. The intake and exhaust valve timing may be controlled concurrently or any of a possibility of variable intake cam timing, variable exhaust cam timing, dual independent variable cam timing, or fixed cam timing may be used. Each cam actuation system may include one or more cams and may utilize one or more of cam profile switching (CPS), variable cam timing (VCT), variable valve timing (VVT), and/or variable valve lift (VVL) systems that may be operated by controller 12 to vary valve operation. For example, cylinder 14 may alternatively include an intake valve controlled via electric valve actuation and an exhaust valve controlled via cam actuation including CPS and/or VCT. In other examples, the intake and exhaust valves may be controlled by a common valve actuator or actuation system, or a variable valve timing actuator or actuation system.

In some examples, each cylinder of engine 10 may include a spark plug 192 for initiating combustion. Ignition system 190 can provide an ignition spark to combustion chamber 14 via spark plug 192 in response to spark advance signal SA from controller 12, under select operating modes. An example configuration of ignition system 190 and spark plug 192 is described below with respect to FIG. 2.

In some examples, each cylinder of engine 10 may be configured with one or more fuel injectors for providing fuel thereto. As a non-limiting example, cylinder 14 is shown including fuel injectors 166 and 170. However, in other examples, the engine 10 may only include one of fuel injectors 166 and 170 and may not include the other of fuel injectors 166 and 170. Fuel injectors 166 and 170 may be configured to deliver fuel received from fuel system 8. Fuel system 8 may include one or more fuel tanks, fuel pumps, and fuel rails. The fuel system 8 may include one or more fuels such as propane, butane, petrol, diesel, biofuels, etc.

Fuel injector 166 is shown coupled directly to cylinder 14 for injecting fuel directly therein in proportion to the pulse width of signal FPW-1 received from controller 12 via electronic driver 168. In this manner, fuel injector 166 provides what is known as direct injection (hereafter referred to as "DI") of fuel into combustion cylinder 14. Thus, fuel injector 166 may also be referred to herein as DI fuel injector 166. The fuel injector 166 may be operated as a low pressure direct injector (LPDI) when injecting liquefied petroleum gas (LPG). Thus, the fuel injector 166 may inject LPG into the cylinder 14 while the cylinder pressure is relatively low as compared to what the cylinder pressure would be when injecting gasoline fuel for example. In the example of FIG. 1 injector 166 is shown positioned overhead cylinder 14 and piston 138, between the spark plug 192 and the intake valve 150. Such a position may improve mixing and combustion when operating the engine with an alcohol-based fuel due to the lower volatility of some alcohol-based fuels. However, in another example, the injector 166 may alternatively be located to the side of cylinder 14. In yet another example, the injector 166 may be located overhead, nearer the intake valve to improve mixing. Fuel may be delivered to fuel injector 166 from a fuel tank of fuel system 8 via a fuel pump and a fuel rail. Further, the fuel tank may have a pressure transducer providing a signal to controller 12. In some examples, the fuel supplied to the DI fuel injector 166 may only be pressurized by a lift pump of the fuel system 8 and not by a higher pressure direct injection pump. However, in other examples, such as where the fuel system 8 is not supplying LPG to the fuel injector 166, the fuel supplied to the injector 166 may be pressurized by both the lift pump and the higher pressure direct injection pump.

Fuel injector 170 may be positioned in intake manifold 146, where the engine intake comprises a single, common passage that supplies airflow to all of the cylinders of engine 10. In such examples, the fuel injector 170 may deliver fuel into the common intake manifold 146, in what is commonly referred to as central fuel injection (CFI). Fuel injector 170 may therefore also be referred to herein as CFI fuel injector 170. Thus, fuel injected by fuel injector 170, may be delivered to any one or more of the cylinders of engine 10. In some examples, only one CFI fuel injector 170 may be included in intake manifold 146 to deliver CFI. However, more than one CFI fuel injector 170 may be included in the intake manifold 146. In some examples, either a CFI injector or port fuel injection (PFI) injectors may be included in the engine 10. Thus, although both CFI and DI injectors are shown in the example of FIG. 1, it should be appreciated that the engine 10 may include only one of the two types of injectors.

Fuel injector 170 may inject fuel, received from fuel system 8 or from a fuel rail of the direct injector 166, in proportion to the pulse width of signal FPW-2 received from controller 12 via electronic driver 171. The fuel injector 170 may receive LPG that has vaporized and become gaseous. Thus, the fuel injector 170 may inject gaseous LPG. Note that a single electronic driver 168 or 171 may be used for all fuel injection systems, or multiple drivers, for example each of electronic drivers 168 and 171 may be employed to inject fuel. For example, electronic driver 168 may be used for fuel injector 166 and electronic driver 171 for fuel injector 170, as depicted in FIG. 1.

In an alternate example, one or more of fuel injectors 166 and 170 may be configured as direct fuel injectors for injecting fuel directly into cylinder 14. In still another example, one or more of fuel injectors 166 and 170 may be configured as port fuel injectors for injecting fuel upstream of intake valve 150. In yet other examples, cylinder 14 may include only a single fuel injector that is configured to receive different fuels from the fuel systems in varying relative amounts as a fuel mixture, and is further configured to inject this fuel mixture either directly into the cylinder as a direct fuel injector or upstream of the intake valves as a port fuel injector. As such, it should be appreciated that the fuel systems described herein should not be limited by the particular fuel injector configurations described herein by way of example.

Fuel may be delivered by one or more of the injectors 166 and 170 to the cylinder 14 during a single cycle of the cylinder 14. For example, each injector may deliver a portion of a total fuel injection that is combusted in cylinder 14. Further, the distribution and/or relative amount of fuel delivered from each injector may vary with operating conditions, such as engine load, knock, and exhaust temperature, such as described herein below. The port injected fuel may be delivered during an open intake valve event, closed intake valve event (e.g., substantially before the intake stroke), as well as during both open and closed intake valve operation. Similarly, directly injected fuel may be delivered during an intake stroke, as well as partly during a previous exhaust stroke, during the intake stroke, and partly during the compression stroke, for example. As such, even for a single combustion event, injected fuel may be injected at different timings from the port and direct injector. Furthermore, for a single combustion event, multiple injections of the delivered fuel may be performed per cycle. The multiple injections may be performed during the compression stroke, intake stroke, or any appropriate combination thereof.

In some examples the injectors 166 and 170 may only inject a single type of fuel (e.g., liquid or vapor) of, for example, LPG. However, in other examples, the injectors 166 and 170 may inject different types or phases (e.g., gaseous and/or vapor) of fuel, depending on engine operating conditions. For example, the injectors 166 and 170 may alternate back and forth between injecting a first fuel type (e.g., gaseous LPG) and a second fuel type (e.g., liquid LPG). In such examples, the injectors 166 and 170 may inject only one type of fuel per injection cycle. However, in other examples, the injectors 166 and 170 may inject multiple types of fuel in a given injection cycle. Injector 166 may inject the same type of fuel for a given injection cycle as injector 170. However, in other examples, the injector 166 may inject a different type of fuel for a given injection cycle than injector 170. For example, injector 166 may inject liquid LPG, while injector 170 may inject gaseous LPG.

As described above, FIG. 1 shows only one cylinder of a multi-cylinder engine. As such, each cylinder may similarly include its own set of intake/exhaust valves, fuel injector(s), spark plug, etc. It will be appreciated that engine 10 may include any suitable number of cylinders, including 2, 3, 4, 5, 6, 8, 10, 12, or more cylinders. Further, each of these cylinders can include some or all of the various components described and depicted by FIG. 1 with reference to cylinder 14.

Fuel injectors 166 and 170 may have different characteristics. These include differences in size, for example, one injector may have a larger injection hole than the other. Other differences include, but are not limited to, different spray angles, different operating temperatures, different targeting, different injection timing, different spray characteristics, different locations etc. Moreover, depending on the distribution ratio of injected fuel among injectors 166 and 170 different effects may be achieved.

Controller 12 is shown in FIG. 1 as a microcomputer, including microprocessor unit 106, input/output ports 108, an electronic storage medium for executable programs and calibration values shown as non-transitory read only memory chip 110 in this particular example for storing executable instructions, random access memory 112, keep alive memory 114, and a data bus. Controller 12 may receive various signals from sensors coupled to engine 10, in addition to those signals previously discussed, including measurement of inducted mass air flow (MAF) from mass air flow sensor 122; engine coolant temperature (ECT) from temperature sensor 116 coupled to cooling sleeve 118; a profile ignition pickup signal (PIP) from Hall effect sensor 120 (or other type) coupled to crankshaft 140; throttle position (TP) from a throttle position sensor; and absolute manifold pressure signal (MAP) from sensor 124. Engine speed signal, RPM, may be generated by controller 12 from signal PIP. Manifold pressure signal MAP from a manifold pressure sensor may be used to provide an indication of vacuum, or pressure, in the intake manifold. The controller 12 may employ the various actuators of FIG. 1 to adjust engine operation based on the received signals from the above-described sensors and based on instructions stored on a memory of the controller (e.g., non-transitory read only memory chip 110, random access memory 112, and/or keep alive memory 114).

In some examples, vehicle 5 may be a hybrid vehicle with multiple sources of torque available to one or more vehicle wheels 55. In other examples, vehicle 5 is a conventional vehicle with only an engine, or an electric vehicle with only electric machine(s). In the example shown, vehicle 5 includes engine 10 and an electric machine 52. Electric machine 52 may be a motor or a motor/generator. Crankshaft 140 of engine 10 and electric machine 52 are connected via a transmission 54 to vehicle wheels 55 when one or more clutches 56 are engaged. In the depicted example, a first clutch 56 is provided between crankshaft 140 and electric machine 52, and a second clutch 56 is provided between electric machine 52 and transmission 54. Controller 12 may send a signal to an actuator of each clutch 56 to engage or disengage the clutch, so as to connect or disconnect crankshaft 140 from electric machine 52 and the components connected thereto, and/or connect or disconnect electric machine 52 from transmission 54 and the components connected thereto. Transmission 54 may be a gearbox, a planetary gear system, or another type of transmission. The powertrain may be configured in various manners including as a parallel, a series, or a series-parallel hybrid vehicle.

Electric machine 52 receives electrical power from a traction battery 58 to provide torque to vehicle wheels 55. Electric machine 52 may also be operated as a generator to provide electrical power to charge battery 58, for example during a braking operation.

Figure 2:
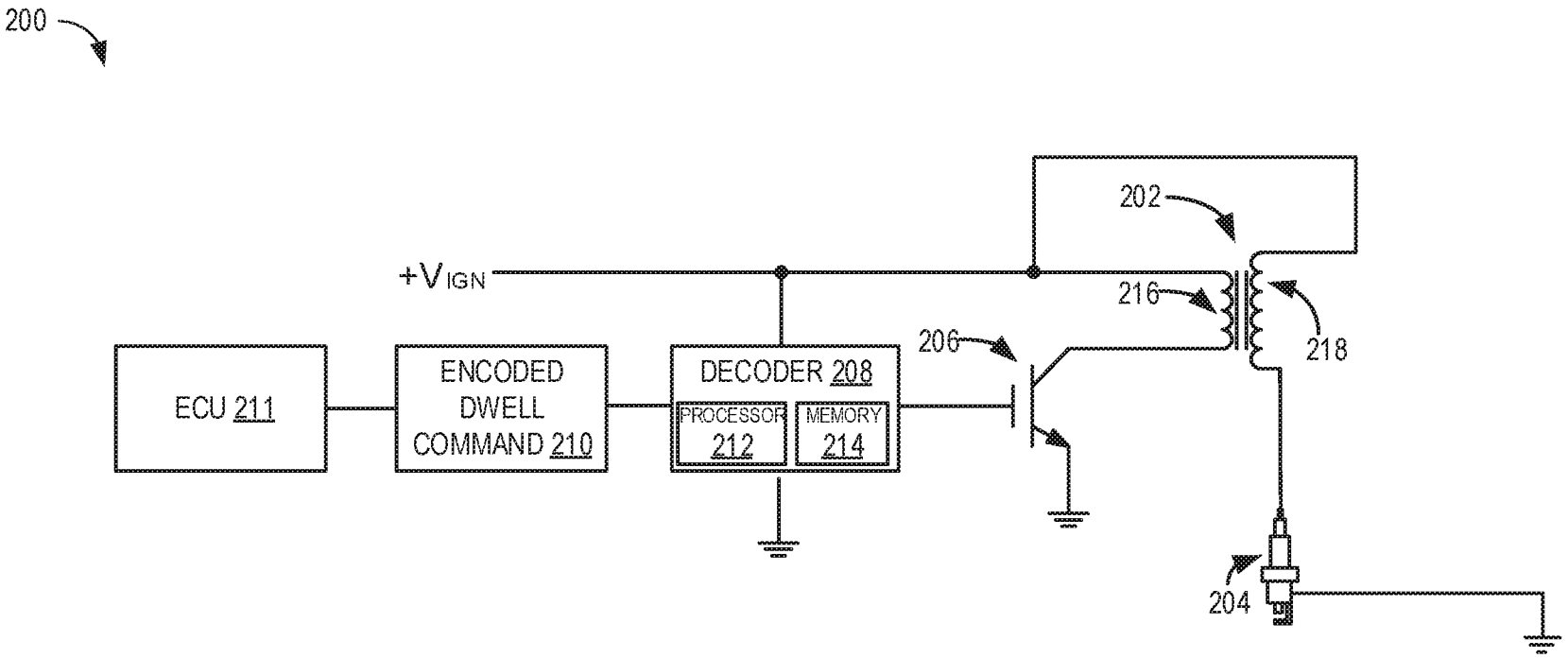
FIG. 2 shows a detailed diagram of an example ignition system.

FIG. 2 shows a detailed diagram of an ignition system 200, which may be an example of ignition system 190 of FIG. 1 and/or otherwise included in an engine of a vehicle. Herein, ignition coil 202 may be an electrical transformer, configured to provide high voltage output to a coupled spark plug 204 downstream of the ignition coil. Ignition coil 202 may be dwelled and fired in response to an encoded dwell command 210 provided by an ECU 211 to the primary windings 216 of the ignition coil. ECU 211 may be an example of ECU 12 of FIG. 1. In one example, an encoded dwell command may be provided to fire the ignition coil for every compression stroke of a combustion cylinder, when the piston is at top dead center position. For example, the ignition coil 202 is dwelled as current is passed through the primary windings 216, generating a magnetic field. The ignition coil 202 is fired due to the cessation or interruption of current passing through the primary windings 216, causing a collapse in the magnetic field and a high voltage pulse across secondary windings 218 of the ignition coil 202 to provide energy to spark plug 204.

A positive input of the primary winding 216 of ignition coil 202 is connected to an ignition voltage source, shown in FIG. 2 as +Vign. In one example, +Vign may be a battery source wherein full battery voltage may be directed to the ignition coil or the full battery voltage sent to the ignition coil may pass via a resistor in order to step down the voltage in order to protect the coils from premature wear. In other examples +Vign may be another suitable electrical power source. An encoded dwell command 210 may be utilized to control the flow of current through ignition coil 202, thereby controlling both the dwell time and the firing of the ignition coil.

As illustrated in FIG. 2, the encoded dwell command 210 and +Vign may be communicatively connected to a decoder 208. Decoder 208 may be further communicatively connected to a solid-state device, such as a transistor 206 or other switching mechanism, for conducting and collapsing the current flow to the primary windings of ignition coil 202 based on the encoded dwell command 210. The decoder 208 and the transistor 206 may comprise an intelligent driver for the control of dwell time of the ignition coil, and may include interpretive logic to decode the dwell commands provided for control of the ignition coil.

The decoder 208 may include a processor 212 communicatively connected to a memory device 214. The processor may be configured to execute computer and/or machine readable non-transitory instructions (e.g., the interpretive logic) stored in the memory of the decoder. In one example, the instructions may include working operations of the decoder and the transistor to perform the decoding and control of dwell in the ignition coil as described above. For example, the decoder 208 may include instructions to evaluate an encoded dwell command in order to determine whether the current flow from +Vign to ignition coil 202 is commanded to be adjusted. Herein, the decoder may be configured to determine a change in the encoded dwell command, e.g., an increase or a decrease in dwell from prior encoded dwell command, in response to an estimated change in engine operating parameters (e.g., engine speed, engine load and/or other parameters). Responsive to detecting a change in the encoded dwell command, decoder 208 may wait for a pre-determined amount of time following which an adjustment to dwell may be made.

Upon expiration of the pre-determined amount of time or after determining a change in the encoded dwell command, decoder 208 may determine the dwell adjustment to be performed. Specifically, if the encoded dwell command comprises an increase in dwell, decoder 208 may initiate and/or increase current flow to the ignition coil by connecting the transistor 206 to the source of high voltage (+Vign) for an extended dwell time to conduct higher current flow to the primary ignition coil relative to a prior current flow provided to the primary ignition coil. In one example, the decoder may include a switching element (e.g., a resistor, not shown) that controls a connection between the transistor and the voltage source. Alternatively, if the encoded dwell command comprises a decrease in dwell, decoder 208 may decrease and/or disrupt or cease current flow to the ignition coil by disconnecting the transistor 206 from voltage source +Vign. In some examples, transistor 206 may be an insulated-gate bipolar transistor (IGBT), which exhibits enhanced efficiency and switching in comparison to other transistor configurations. The decoder may comprise a logic unit with instructions and operators formed therein for decoding encoded signals, as described herein.

FIG. 3 shows a flowchart illustrating a method 300 for adjusting dwell time in cooperation with an ignition system, such as the ignition system configuration of FIG. 2. Instructions for carrying out method 300 may be executed by a controller, such as controller 12 of FIGS. 1 and 2, based on instructions stored in the memory of the controller and in conjunction with signals received from various sensors of the engine system, such as the sensors described above with reference to FIG. 1. The instructions for method 300 may be executed by a processor (e.g., processor 212 of the decoder 208 of FIG. 2, the ECU 12 of FIG. 1, and/or the ECU 211 of FIG. 2) to actuate a switching mechanism, (e.g., transistor 206 of FIG. 2) for controlling operation of an ignition coil (e.g., ignition coil 202 of FIG. 2) to generate a spark at a spark plug (e.g., spark plug 204 of FIG. 2). At 302, method 300 includes estimating engine operating conditions. These may include, for example, engine speed, engine load, boost level, engine temperature, exhaust temperature, barometric pressure, fuel composition, particulate filter load, etc. Estimating engine and transmission (final drive gear ratio) operating conditions may additionally include determining a mileage that may be accumulated over time and stored in the memory of controller 12. At 304, the method may include outputting a first dwell time from a base dwell table derived from estimated engine operating conditions. In one example, dwell may be empirically determined and stored in a pre-determined lookup table or functions. The controller may determine the first dwell based on a lookup table such as a base dwell table with the input being relative engine load and engine speed and the output being dwell time. Furthermore, the table may output a duration of time for which current may be conducted through the ignition coil to be able to obtain the required outputted switch current (e.g. where the switch current is the amount and/or duration of current supplied to the ignition coil). Such a table may be stored in the memory of the controller for looking up dwell output when the engine speed and load are determined. As another example, the controller may make a logical determination (e.g., based on current engine speed and load information obtained from speed and load sensors) based on logic rules that are a function of estimated engine operating conditions. The controller may then generate a control signal based on the logical determination, and send the control signal to an actuator, such as a switching mechanism (e.g., transistor 206 of FIG. 2) for controlling firing of a spark plug via an ignition coil.

At 306, method 300 includes determining if engine speed and load exceeds a pre-determined threshold. The threshold referred to at 306 may be an engine speed and/or load threshold which, when deviated from, may cause the engine system to be in a state that may benefit from an adjustment of dwell in the ignition system 200 based on spark plug age and spark plug gap size (e.g., by decreasing wear on the spark plug and/or increasing efficiency in generating a spark via the spark plug). The threshold referred to at 306 may further be at least one non-zero positive value threshold. For example, the threshold referred to at 306 may include a non-zero positive speed threshold and a non-zero positive load threshold (e.g., which may be a different value than the speed threshold). When the vehicle is operating at above either or both of the speed and load thresholds, fuel may be less difficult to ignite than when operating at below either or both of the speed and load thresholds. In some examples, only the load may be evaluated relative to the threshold at 306, whereas in other examples, only the speed may be evaluated relative to the threshold at 306. In still other examples, speed for a given load may be evaluated relative to the threshold at 306, or load for a given speed may be evaluated relative to the threshold at 306.

If the engine speed and/or load are determined to be greater than the threshold at 306, the method proceeds to 308 to further determine if the spark plug age and/or spark plug gap size exceed a threshold. The threshold referred to at 308 may correspond to an associated threshold value of spark plug age and/or spark plug gap size at which the base dwell time from the lookup table described at 304 may be used (e.g., where there are no or minimal effects on spark plug aging and/or firing efficiency resulting from adjustments to dwell timing). The threshold described at 308 may be derived from and/or equal to the spark plug age and/or gap size used to derive the base dwell times of the table described at 304 (e.g., a worst-case scenario) and may be a non-zero positive value threshold. The spark plug age may be correlated with the gap size between the spark plug electrodes in one example, wherein first, new spark plug may have a relatively smaller gap size than a second, old spark plug (e.g., older than the first spark plug). In other words, with time as the spark plugs age with use, the gap size may grow wider. Further, any adjustments made to dwell in an ignition system may be made in accordance with either or both of spark plug age and gap size which may trend together as explained above. For example, the threshold described at 308 may include only a spark plug age threshold to which a current spark plug age is compared, or may include only a spark plug gap size threshold to which a current spark plug gap size is compared in some examples. In other examples, the threshold described at 308 may include a threshold spark plug age for a given spark plug gap size or a threshold spark plug gap size for a given spark plug age. In still other examples, the threshold described at 308 may include both a threshold spark plug age and a threshold spark plug gap size, such that the spark plug age and gap size is determined to be above (or below) the threshold responsive to determining that either or both of the spark plug age and the spark plug gap size are above (or below) the respective associated threshold.

If at 308, it is determined that spark plug age and/or gap size is greater than the associated threshold at engine load and/or speed that is higher than the associated threshold, then method 300 moves forward to 310 to apply a scaling factor to the first dwell time (obtained at 304) to increase dwell and obtain an adjusted dwell time (e.g. switch current) corresponding to the increased dwell (relative to the first dwell time). Upon determining that the spark plug age and/or gap size is above the associated threshold, the dwell time may be adjusted proportional to spark plug conditions (e.g., age and/or gap size between spark plug electrodes). For example, a gap size between spark plug electrodes may be derived based on mileage information obtained, and further based on actual spark plug electrode material used and spark plug geometry. For the ignition system to operate at a selected dwell for optimal spark plug firing, a scalar quantity may be calculated, which when multiplied with currently operating dwell (e.g., the first/base dwell time) would yield the adjusted dwell time as mentioned earlier. In one example, a range of scalar quantities and the adjusted values of dwell derived from a first dwell may be included in the base dwell table or another dwell table, further stored in the memory of the controller. For example, in addition to the base dwell table, additional lookup tables comprising scalar quantities and adjusted dwell times may be available. Following the determination of the spark plug age and gap size being greater than threshold (e.g., YES at 308), at 310 a scalar factor may be derived from the lookup tables and/or calculations described above and may be applied (e.g., multiplied) with the first dwell time from 304. The scalar factor may be a larger multiplication factor (e.g., greater than 1) such that when multiplied with first dwell, the scalar factor may serve to increase dwell from the first dwell time to an adjusted dwell time based on spark plug condition (e.g., age and/or gap size above threshold) of the ignition system of an engine operating with a greater than threshold speed and/or load. However, if spark plug age and gap size are determined to be not greater than the associated threshold (e.g., NO at 308), then method 300 moves to 312 to apply a different scalar factor (than the scalar factor applied at 310) which may be a smaller multiplication factor (e.g., less than 1 and/or smaller than the scalar factor applied at 310) such that when applied to the first dwell time, the scalar factor may serve to decrease dwell time to obtain an adjusted dwell time that is shorter than the first dwell time. The adjusted dwell time obtained at 312 may be based on spark plug condition of an engine operating with a greater than threshold speed and load.

Referring back to 306, if the engine speed and load are determined to not exceed the threshold at 306 (e.g., NO at 306, thereby corresponding to low engine speed and load conditions), the method proceeds to 314 to further determine if the spark plug age and spark plug gap size exceed a threshold. The threshold referred to at 314 may be the same as the threshold described at 308. As described earlier, the spark plug gap size may be a function of spark plug age, wherein older spark plugs may have a relatively wider gap size while newer spark plugs may include a relatively smaller gap size than the older spark plugs. Further, any adjustments made to dwell in an ignition system may be made in accordance with both spark plug age and gap size which may trend together as explained above. If at 314, it is determined that spark plug age and/or gap size are greater than threshold at engine load and/or speed that is lower than threshold (e.g., YES at 314), then method 300 moves forward to 316 to apply a scalar factor to the first dwell time to decrease dwell and obtain an adjusted dwell time that is shorter than the first dwell time. Following the determination of the spark plug age and gap size being greater than threshold (e.g., YES at 314), at 316 a scalar factor from the lookup tables may be applied (e.g., multiplied) to the first dwell time from 304. The scalar factor may be different from the scalar factor applied at 310 and/or 312, and may be a small multiplication factor (e.g., less than 1) such that when multiplied with first dwell, may serve to decrease dwell from first dwell to an adjusted dwell time based on spark plug condition (e.g., age and gap size above threshold) of the ignition system of an engine operating with a lower than threshold speed and load. However, if at 314 spark plug age and gap size are determined to be not greater than the threshold (e.g., NO at 314), then method 300 moves to 318 to obtain an adjusted dwell time by applying a scalar factor which may be a larger multiplication factor (e.g., larger than the scalar factor applied at 316 and/or greater than 1) such that when applied to the first dwell time, may serve to increase dwell time relative to the first/base dwell time. The adjusted dwell time obtained at 318 may be based on spark plug condition of an engine operating with a lower than threshold speed and load.

At 320, method 300 includes operating the ignition system (e.g., ignition system 200 of FIG. 2) according to the adjusted dwell time. It is to be understood that the ignition system may, in some examples, be operating according to the first (e.g., base) dwell time for given operating conditions when a speed and/or load is equal to the threshold described at 306 and/or when the spark plug age and gap size is equal to the threshold described at 308. In some examples, when the engine speed and load and/or the spark plug age and gap size are approximately equal to the respective associated thresholds, the scalar factor applied to the first (e.g., base) dwell time may be substantially one, thus operating the ignition system according to the adjusted dwell time is substantially equivalent to operating the ignition system according to the first (e.g., base) dwell time under such conditions. Operating the ignition system according to the adjusted dwell time may include providing an encoded dwell signal to an ignition coil to dwell and fire the ignition coil at the adjusted dwell time.

At 322, method 300 determines if a change in engine operating conditions from prior detected operating conditions is detected. For example, after outputting the adjusted dwell time, the system may monitor operating conditions to determine whether a change in engine operating conditions (e.g., a change in engine operating conditions above an associated threshold, where different thresholds may be utilized for different operating conditions) has occurred since the adjusted dwell time was output. A change in engine operating conditions may include a change in engine speed, change in engine load, change in engine temperature, change in the composition of fuel supplied for combustion, change in particulate matter accumulated on the particulate filter, etc. If it is determined at 322 that there is no change in engine operating conditions from prior operating conditions (e.g., the operating conditions estimated at 302) then the method moves to 324 to continue to maintain engine operation. Maintaining engine operation includes maintaining firing the spark plugs in the ignition system according to the adjusted dwell obtained at one of 310, 312, 316, or 318 (e.g., maintaining operating of the ignition system as described at 320). However, if a change in engine operating conditions is detected at 322, then method 300 returns to 302 to estimate engine operating conditions and adjust dwell time based thereon.

In this way, calibrating dwell time by applying a scalar factor to adjust dwell time based on engine load and speed and further based on spark plug conditions such as age and gap size of spark plug, a more suitable level of dwell may be used for ignition compared to dwell derived from a base dwell table for worst case scenario conditions. For an engine operating at idle or low speed and load conditions, a higher dwell may be supplied for spark plugs that are newer comprising relatively smaller gap sizes. With time and use, as the spark plug ages and gap size grows, dwell may be suitably reduced and in one example, may be combined with a longer spark duration to ensure ignition. Alternatively, for an engine operating at high speed and load conditions, a lower dwell may be supplied for spark plugs that are newer and comprise relatively smaller gap sizes. With time and use, as the spark plug ages and gap size grows, dwell may be suitably increased to ensure ignition. By supplying a suitable dwell proportional to actual spark plug gap size and/or age, the wear rate of the spark plug would be reduced thereby reducing component degradation.

In one example, a plug gap size is estimated as a function of a pre-determined incremental wear rate (gap change/mileage) and actual mileage change from the previous determination. The pre-determined wear rate may also be adjusted responsive to an average engine load over the mileage change from the last calculation, with the rate increasing for higher on-average engine load over the mileage change. Further modifications may be based on spark plug geometry and electrode material of the particular spark plug for the engine/vehicle combination to calculate the instantaneous spark gap size and consequently the required dwell scalar to adjust target dwell time to meet engine demands. The target dwell time may be based on engine load and/or other instantaneous engine operating conditions for prevailing operating conditions. In this way, by combining the adjustment based on wear rate to the target based on engine operating conditions, a more accurate dwell time can be used for controlling the coil current.

Factors contributing to spark gap wear rate are a function of the spark breakdown voltage, the anode and cathode electrode temperatures, the ignition coil secondary spark current, and the spark plug gap size. Examples include the number of spark events due to engine speed or due to the use of repetitive spark at idle during one combustion event to add supplemental energy beneficial to the combustion process. An increase in the total energy delivered to the spark plug gap by the use of multiple or repetitive spark events while the flame kernel is still growing, may prove beneficial at light loads such as idle. Additional factors contributing to spark gap wear include the spark plug electrode temperature due to corrosion and oxide vaporization (oxidation induced wear) in one example, spark energy erosion due to the energy stored in the spark plug capacitance and discharged in the spark breakdown event in another example, and spark energy erosion due to the ignition coil inductive stored energy discharged during spark duration glow phase in yet another example.

For example:

Spark Gap Wear Rate by Operating Condition=(Material Volume Lost per Spark)×(Spark Plug Electrode Temperature Scalar)×(Spark Voltage Scalar)×(Secondary Energy Scalar)=Total Volume Lost per Spark Event Several unique operating conditions may be evaluated separately and then summed together. Examples may include the unique operation found during conditions of rural driving versus urban roads or mountain or highway driving or even trailer towing.

Total Spark Gap Wear=(Spark Plug Wear Rate for Operating Condition 1 . . . *n*)×(Number of Spark Events for Operating Condition 1 . . . *n*)

Scalars may be determined from empirical study or material properties.

Figure 4:
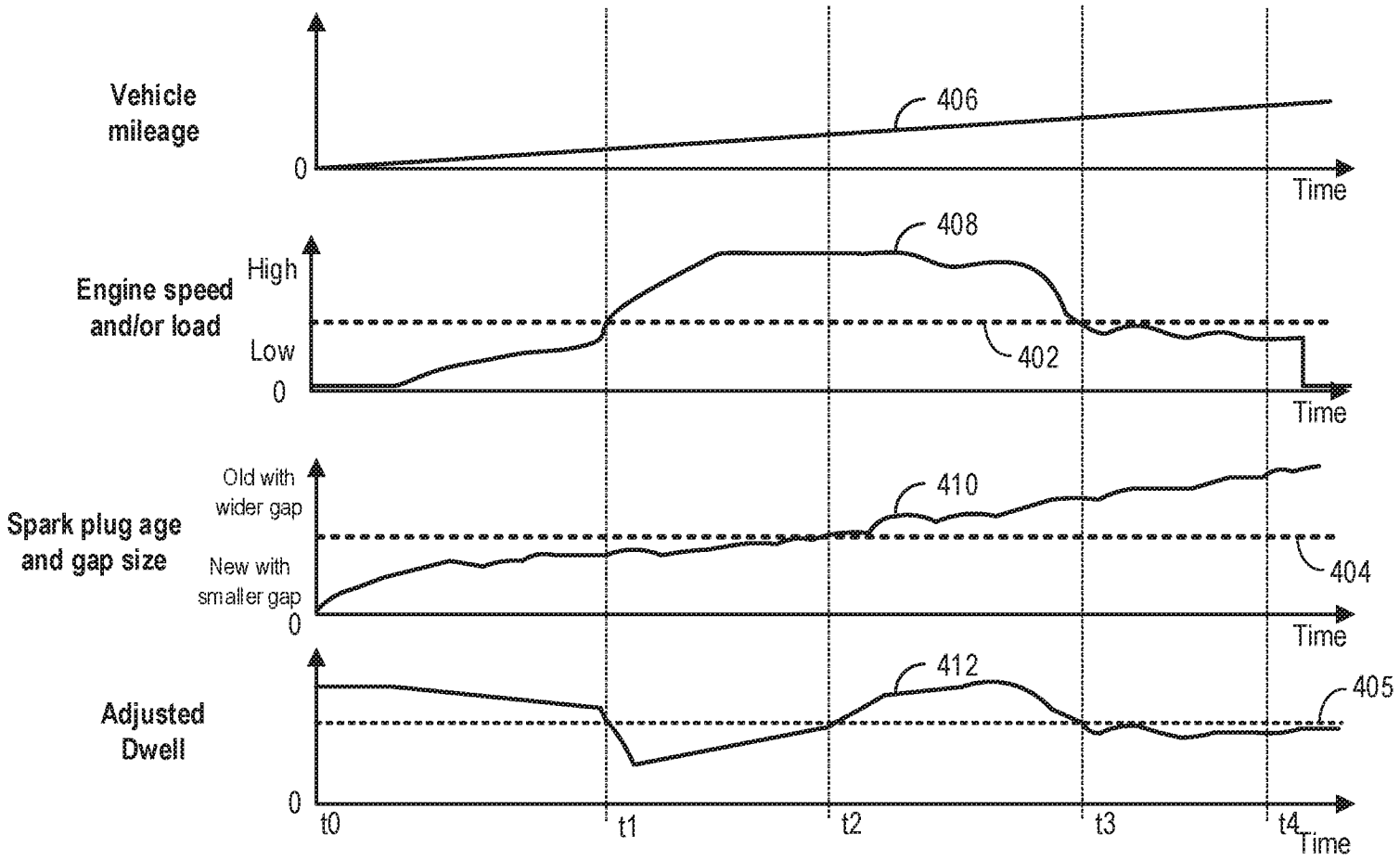
FIG. 4 shows waveforms illustrating variations in engine operating parameters over time based on spark plug condition.

FIG. 4 shows waveforms illustrating example variations in engine operating parameters over time based on spark plug condition in accordance with the method described in FIG. 3. In the illustrated waveforms the y-axis corresponds to the parameter indicated adjacent to the associated waveform, while each of the x-axes correspond to a shared timeline wherein times t1, t2 and t3 identify times at which a change in engine operation is observed/controlled. The first plot from the top (waveform 406) shows vehicle mileage over time, which steadily increases along the timeline. The second plot (waveform 408) denotes the engine speed and load that varies over time. The dotted line 402 depicts an example threshold engine load and/or speed, a deviation from which may cause the engine to benefit from adjustment of dwell time based on spark plug conditions. The third plot (waveform 410) shows spark plug age and spark plug gap size over time. The dotted line 404 in the third plot depicts an example threshold spark plug gap size and/or spark plug age, wherein based on operating engine speed and/or load, dwell time may be adjusted depending on the calculated spark plug gap size and/or age being above or below this threshold. The fourth plot (waveform 412) shows adjusted dwell relative to a normalized base dwell 405 (e.g., normalized to the engine speed and/or load at each point along the timeline), where the adjusted dwell is adjusted in accordance with engine speed and/or load and further based on spark plug gap size and/or age using a dwell adjustment such as the method of adjusting dwell shown in FIG. 3. The base dwell 405 may represent the base dwell at each point in time for the given engine speed and/or load depicted at waveform 408 at that time (e.g., based on a dwell table, as described above).

At time t0, engine operation at low speed and/or load with spark plug that is newer and has a relatively smaller gap size is depicted. The adjusted dwell at t0 is therefore set to be higher (e.g., set to a first, high level compared to the associated base dwell for the respective engine speed and/or load) to ensure that ignition occurs at engine operating conditions while the spark plug age and/or gap is below the associated threshold. During time period t0-t4, vehicle mileage steadily increases as shown by waveform 406 that correlates with the use and wear of the spark plugs of the ignition system, wherein waveform 410 shows newer spark plugs with smaller gaps during t0-t2 and older spark plugs with wider gaps during t2-t4. At time t1, a change in engine operating conditions greater than threshold is observed shown by waveform 408. A controller such as controller 12 of FIG. 1 may determine a change in engine operation based on communication from various sensors of engine 5 of FIG. 1 as described in method 300 of FIG. 3 above. Specifically a change in engine speed and/or load may be estimated (based on information from speed and load sensors) and the controller may determine if the estimated engine speed and load are greater than threshold depicted by dotted line 402. If the estimated engine speed and/or load are determined to be above threshold speed and load, an engine may be operating at high engine speed and/or load and dwell may be accordingly adjusted. The dwell adjustment to be made may further depend on spark plug conditions existent at time t1. Thus at time t1, controller 12 may further determine if the operating spark plug gap size and/or age are greater than a threshold gap size and/or age depicted as dotted line 404. As shown by waveform 410 during time period t1-t2, spark plug gap size and age may be below threshold at engine speed and/or load which are high (e.g. waveform 408 during t1-t2), thus dwell time may be adjusted to decrease dwell relative to the associated base dwell (represented by line 405) as shown by waveform 412 during t1-t2. The decrease in dwell may be proportional to the spark plug conditions determined during this time period.

During time period t2-t3, engine operating conditions observed may continue to be greater than threshold as shown by waveform 408. A controller such as controller 12 of FIG. 1 may continue to monitor engine operation based on communication from various sensors of the engine as described earlier. As the mileage of the vehicle increases steadily, use and wear of spark plugs may cause spark plugs to become older and the respective gap sizes to become wider, which creates conditions in which the engine may benefit from a change in dwell (e.g., to increase efficiency of sparking and/or improve reliability of sparking, as described above). As shown by waveform 412 during t2-t3, dwell may be accordingly adjusted to increase relative to the associated base dwell represented at line 405 to match the demands of increasing gap size (e.g., a larger gap size may call for more dwell to fire) at high engine speed and load conditions. Adjustment to dwell during the time period t2-t3 is based on spark plug condition while engine operating conditions during t2-t3 remain above the threshold 402 as was experienced during operation from t1-t2 earlier.

At time t3, another change in engine operating conditions is observed shown by waveform 408. A controller such as controller 12 of FIG. 1 may determine such a change in engine operation from various sensors of engine as described in FIG. 3 earlier. Specifically, a decrease in engine speed and load is seen from waveform 408 during t3-t4 wherein engine speed and/or load are observed to be below threshold 402. As vehicle mileage steadily increases (shown by waveform 406), use of the ignition system ages the spark plugs and may result in gap sizes becoming wider, causing spark plug conditions to be greater than a threshold gap size and age. Thus, dwell may be adjusted dependent on spark plug conditions and below threshold engine operating conditions existent during t3-t4. The controller may therefore adjust dwell time to decrease dwell relative to the associated base dwell represented at 405 as shown by waveform 412 during t3-t4, wherein the decrease in dwell may be proportional to the determined spark plug age and gap size. As spark plug age and/or gap size becomes closer to the "worst case scenario" conditions for which the base dwell is derived, the adjustment to dwell may be provided to a decreasing degree (e.g., where an absolute value of an adjustment for a given speed/load condition during time t2-t3 may be higher than an absolute value of an adjustment for the same speed/load condition after time t4, since the spark plug condition may be closer to the conditions used to derive the base dwell after time t4 than during time t2-t3).

In this way, dwell adjustments based on engine load and speed and further based on spark plug conditions such as age and gap size of spark plug may provide a more reliable and improved level of dwell control in ignition systems relative to using a base dwell that is predetermined and/or derived based on worst-case scenario conditions (e.g., an end-of-life spark plug). By supplying a higher dwell for newer spark plugs with relatively small gap sizes at low engine speed and load conditions, and proportionately reducing dwell as the spark plug ages and gap size grows, the disclosed systems and methods may improve (e.g., decrease) the rate at which spark plugs wear out. Alternatively, by supplying a lower dwell for newer spark plugs with relatively small gap sizes at high engine speed and load conditions, and proportionately increasing dwell, as the spark plug ages and gap size grows, the disclosed systems and methods may reduce the wear rate of sparkplugs and the aging of ignition coil due to excessive heating. Thus, a calibrated dwell that is based on engine operating conditions and is further adjusted proportionate to the actual spark plug gap size and/or age may not only extend the life of ignition system components but may improve engine performance.

The technical effect of performing a dwell adjustment proportionate to spark plug gap size and/or age in an ignition system is that premature wear of the spark plug and the ignition coil may be prevented. By adjusting dwell output proportional to a determined spark plug gap size and spark plug age, and further based on engine operating conditions such as engine speed and load, power outputs from the ignition system and therefore vehicle may be improved.

A method for an engine includes adjusting ignition coil dwell based on engine operating conditions and further adjusting the ignition coil dwell in proportion to existent spark plug conditions to derive an adjusted ignition coil dwell time controlling a supply of current to an ignition coil. A first example of the method includes the method, wherein the adjusted ignition coil dwell time is adjusted relative to a base dwell time derived from a look-up table for the engine operating conditions. A second example of the method optionally includes the first example and further includes the method, wherein the engine operating conditions include one or more of a speed and a load of the engine and the existent spark plug conditions include one or more of a spark plug gap size and a spark plug age. A third example of the method optionally includes one or both of the first and second examples, and further includes the method, wherein the engine is operated at one or more of a speed and a load that is below an associated first threshold while the spark plug conditions are above an associated second threshold, and wherein the adjusted ignition coil dwell time is lower than a base dwell time for the engine operating conditions. A fourth example of the method optionally includes one or more or each of the first through third examples, and further includes the method, wherein the engine is operated at one or more of a speed and a load that is above an associated first threshold while the spark plug conditions are above an associated second threshold, and wherein the adjusted ignition coil dwell time is higher than a base dwell time for the engine operating conditions. A fifth example of the method optionally includes one or more or each of the first through fourth examples, and further includes the method, wherein the engine is operated at one or more of a speed and a load that is below an associated first threshold while the spark plug conditions are below an associated second threshold, and wherein the adjusted ignition coil dwell time is higher than a base dwell time for the engine operating conditions. A sixth example of the method optionally includes one or more or each of the first through fifth examples, and further includes the method, wherein the engine is operated at one or more of a speed and a load that is above an associated first threshold while the spark plug conditions are below an associated second threshold, and wherein the adjusted ignition coil dwell time is lower than a base dwell time for the engine operating conditions.

An engine operation method comprises adjusting ignition coil dwell of a spark plug coupled in an engine cylinder based on engine operating conditions and in proportion to determined plug gap size and applying the adjusted ignition coil dwell by controlling a supply of current to an ignition coil based on the adjusted ignition coil dwell. A first example of the method includes the method, wherein the engine operating conditions include engine load. A second example of the method optionally includes the first example and further includes the method, wherein the plug gap size is based on vehicle mileage. A third example of the method optionally includes one or both of the first and second examples, and further includes the method, wherein the plug gap size is further based on a wear rate and the vehicle mileage. A fourth example of the method optionally includes one or more or each of the first through third examples, and further includes the method, wherein the wear rate is further based on an average engine load over a period. A fifth example of the method optionally includes one or more or each of the first through fourth examples, and further includes the method, wherein the wear rate is further based on a spark plug material. A sixth example of the method optionally includes one or more or each of the first through fifth examples, and further includes the method, wherein the wear rate is further based on one or more of a spark breakdown voltage, anode and cathode electrode temperatures, and ignition coil secondary spark current. A seventh example of the method optionally includes one or more or each of the first through sixth examples, and further includes the method, wherein the wear rate is further based on a number of spark events.

The disclosure further provides for a system comprising an engine with a cylinder having a spark plug located therein and a controller with memory having instructions stored therein and coupled to a coil of the spark plug, the instructions including code for, during engine loads below a threshold load, adjusting a dwell time responsive to a determined gap size as a function of plug age, including a larger multiplication factor applied to a base dwell table, the base table based on engine load to provide a resulting dwell time for higher primary current and stored energy at smaller gaps than at larger gaps, with the factor decreasing as the spark plug ages and grows to match a reduction in energy demands and during loads higher than the threshold, adjusting the dwell time responsive to a determined gap size as a function of plug age, including a smaller multiplication factor applied to the based dwell table to provide a resulting dwell time for lower primary current and reduced stored energy at smaller gaps than at larger gaps. A first example of the system includes the system, wherein the gap size is further based on a vehicle mileage and a wear rate of the spark plug. A second example of the system optionally includes the first example, and further includes the system, wherein the wear rate is further based on an average engine load over a period. A third example of the system optionally includes one or both of the first and second examples, and further includes the system, wherein the wear rate is further based on one or more of a spark breakdown voltage, anode and cathode electrode temperatures, and ignition coil secondary spark current. A fourth example of the system optionally includes one or both or each of the first through third examples, and further includes the system, wherein the wear rate is further based on a number of spark events over a period.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to I-3, I-4, I-5, I-6, V-6, V-8, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for an engine, the method comprising:

adjusting ignition coil dwell based on engine operating conditions; and further adjusting the ignition coil dwell in proportion to existent spark plug conditions including spark plug gap size to derive an adjusted ignition coil dwell time controlling a supply of current to an ignition coil, the method further including determining the spark plug gap size as a function of a wear rate.

2. The method of claim 1, wherein the adjusted ignition coil dwell time is adjusted relative to a base dwell time derived from a look-up table for the engine operating conditions.

3. The method of claim 1, wherein the engine operating conditions include one or more of a speed and a load of the engine and the existent spark plug conditions further include a spark plug age.

4. The method of claim 3, wherein the engine is operated at one or more of a speed and a load that is below an associated first threshold while the spark plug conditions are above an associated second threshold, and wherein the adjusted ignition coil dwell time is lower than a base dwell time for the engine operating conditions.

5. The method of claim 3, wherein the engine is operated at one or more of a speed and a load that is above an associated first threshold while the spark plug conditions are above an associated second threshold, and wherein the adjusted ignition coil dwell time is higher than a base dwell time for the engine operating conditions.

6. The method of claim 3, wherein the engine is operated at one or more of a speed and a load that is below an associated first threshold while the spark plug conditions are below an associated second threshold, and wherein the adjusted ignition coil dwell time is higher than a base dwell time for the engine operating conditions.

7. The method of claim 3, wherein the engine is operated at one or more of a speed and a load that is above an associated first threshold while the spark plug conditions are below an associated second threshold, and wherein the adjusted ignition coil dwell time is lower than a base dwell time for the engine operating conditions.

8. The method of claim 1, wherein the wear rate is based on an average engine load over a mileage, with the wear rate increasing for higher on-average engine loads over the mileage.

9. An engine operation method, comprising:

adjusting ignition coil dwell of a spark plug coupled in an engine cylinder based on engine operating conditions including engine load and in proportion to determined plug gap size based on vehicle mileage; and applying the adjusted ignition coil dwell by controlling a supply of current to an ignition coil based on the adjusted ignition coil dwell.

10. The method of claim 9, wherein the plug gap size is further based on a wear rate and the vehicle mileage.

11. The method of claim 10, wherein the wear rate is further based on an average engine load over a period.

12. The method of claim 11, wherein the wear rate is further based on a spark plug material.

13. The method of claim 10, wherein the wear rate is further based one or more of a spark breakdown voltage, anode and cathode electrode temperatures, and ignition coil secondary spark current.

14. The method of claim 10, wherein the wear rate is further based on a number of spark events.

15. A system, comprising:

an engine with a cylinder having a spark plug located therein; and a controller with memory having instructions stored therein and coupled to a coil of the spark plug, the instructions including code for:

during engine loads below a threshold load, adjusting a dwell time responsive to a determined gap size as a function of plug age, including a larger multiplication factor applied to a base dwell table, the base table based on engine load to provide a resulting dwell time for higher primary current and stored energy at smaller gaps than at larger gaps, with the multiplication factor decreasing as the spark plug ages and grows to match a reduction in energy demands; and during engine loads higher than the threshold, adjusting the dwell time responsive to a determined gap size as a function of plug age, including a smaller multiplication factor applied to the based dwell table to provide a resulting dwell time for lower primary current and reduced stored energy at smaller gaps than at larger gaps.

16. The system of claim 15, wherein the gap size is further based on a vehicle mileage and a wear rate of the spark plug.

17. The system of claim 16, wherein the wear rate is further based on an average engine load over a period.

18. The system of claim 16 wherein the wear rate is further based on one or more of a spark breakdown voltage, anode and cathode electrode temperatures, and ignition coil secondary spark current.

19. The system of claim 16, wherein the wear rate is further based on a number of spark events over a period.

* * * * *